United States Patent [19]

Jelberyd et al.

[11] Patent Number: 4,466,354

[45] Date of Patent: Aug. 21, 1984

[54] APPARATUS FOR CHARGING RISING DRILLHOLES

[75] Inventors: Leif Jelberyd, Handen; Gunnar Egerström, Danderyd, both of Sweden

[73] Assignee: Nitro Nobel AB, Gyttorp, Sweden

[21] Appl. No.: 363,495

[22] Filed: Mar. 30, 1982

[30] Foreign Application Priority Data

Apr. 3, 1981 [SE] Sweden ..... 8102164

[51] Int. Cl.[3] ..... F42B 3/00

[52] U.S. Cl. ..... 102/313; 86/20 C; 299/14

[58] Field of Search ..... 102/312, 313; 86/20 C; 299/14

[56] References Cited

U.S. PATENT DOCUMENTS

| | | | |
|---|---|---|---|
| 2,818,809 | 1/1958 | Roy | 86/20 C X |
| 3,125,925 | 3/1964 | Ljungberg | 102/313 X |
| 3,752,229 | 8/1973 | Pridy | 166/77 X |
| 3,907,044 | 9/1975 | Robertson | 299/14 X |
| 4,036,100 | 7/1977 | Hurley | 86/20 C |
| 4,051,988 | 10/1977 | Egerström et al. | 86/20 C X |

FOREIGN PATENT DOCUMENTS

| | | | |
|---|---|---|---|
| 970606 | 7/1975 | Canada | 86/20 C |
| 2939966 | 4/1981 | Fed. Rep. of Germany | 102/313 |

*Primary Examiner*—Peter A. Nelson

*Attorney, Agent, or Firm*—Shlesinger, Arkwright, Garvey & Fado

[57] ABSTRACT

An apparatus for the charging of rising drillholes (10), preferably large holes of diameter approximately 100 mm or more, with pipecharges (22). The aim is to make it possible to feed charges into the hole in such a way as to fill the hole effectively while making it easy to apply the necessary firing gear (primer and detonator). The charging apparatus comprises a stand (14) capable of being aligned with the mouth (28) of a drillhole by pivoting on a fixed surface (26). The stand includes a lifting means (18) which is provided with a rest (20) capable of travelling towards and away from the drillhole, to carry pipecharges. That part of the stand which is aligned with the drillhole consists of a guide unit (16) which is arranged to guide the pipecharges into the drillhole as the rest travels towards the said drillhole. The pipecharges are retained in place after the lift by retaining means (30).

4 Claims, 10 Drawing Figures

Figures 1A, 1B, 1C, 1D, 1E, 1F:
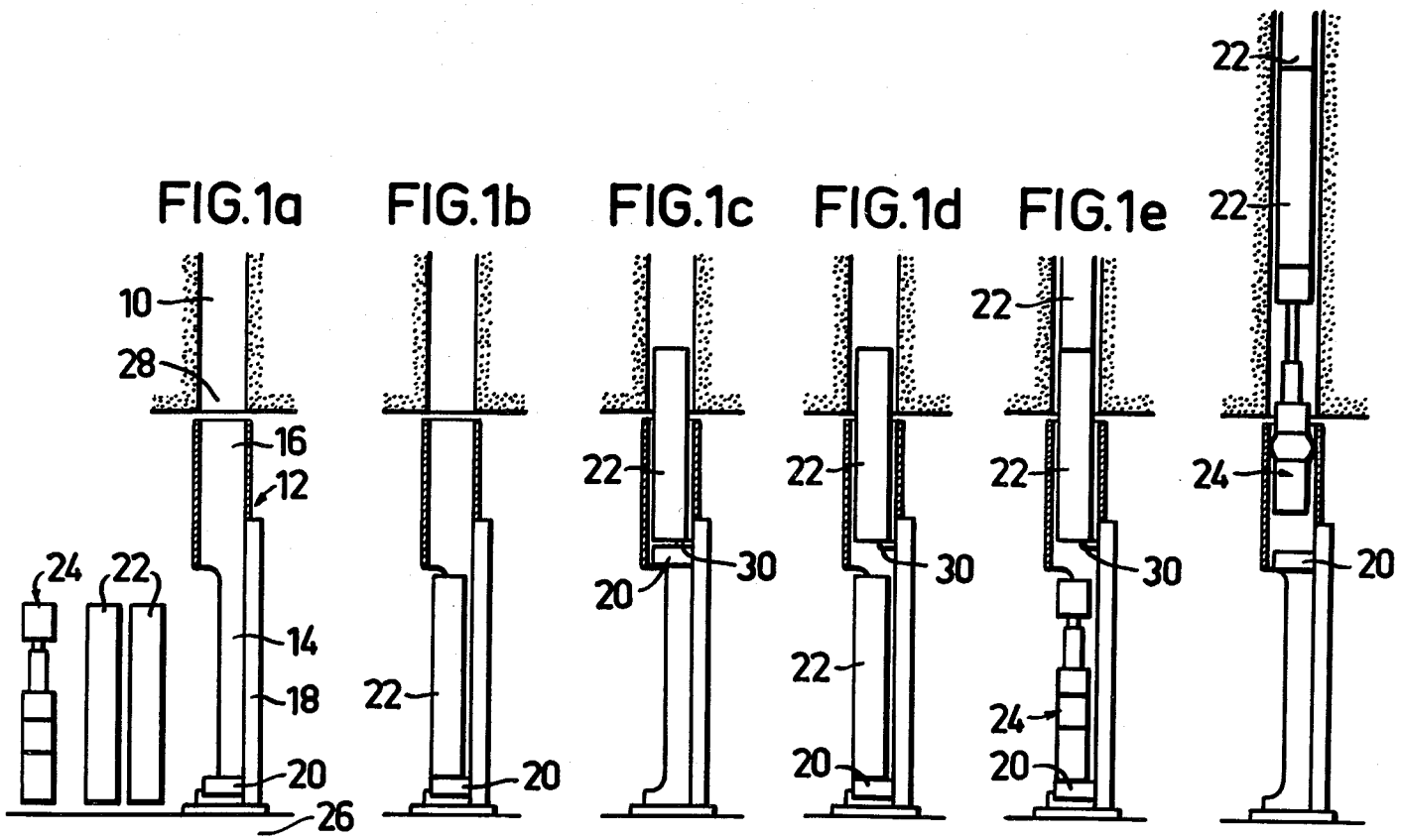

10
12
14
16
18
20
22
24
26
28
30

APPARATUS FOR CHARGING RISING DRILLHOLES

The present invention is concerned with an apparatus for the charging of rising drillholes with pipecharges. In particular, the apparatus is designed for the mechanized charging of so-called large holes, which may have a diameter in the order of 90 mm or more.

The charging of rising shotlines has previously been substantially manual. However, it has long been a known practice to use various types of tamping sticks. Recent trends have increasingly tended towards the further mechanization of charging procedures, but in the case of large holes of the size mentioned above no reliable charging procedure has yet gained general acceptance. It may be worth while in this connection to mention the so-called Meramec method, using slurry, and the African snow-charging method, using powdered ANFO (ammonium nitrate-fuel oil).

In the above-mentioned Meramec method a water-based explosive is pumped into the hole through a charging hose which is sealed against the mouth of the hole. In the snow-charging method a double hose is used, comprising a thinner hose fitting loosely inside a thicker hose which is inserted into the hole and sealed against the mouth thereof. The powdered ANFO explosive is then blown into the hole through the inner hose and, settling in the form of "snow", fills the hole from mouth to bottom.

In the said known procedures for charging large holes there is no way of reliably verifying that the hole is actually filled with explosive. Hence one cannot discount the risk that the charging operation may be vitiated, by cracks in the rock, for example, through which explosive can leak away. Air pockets may also form in the drillhole itself and cause discontinuous filling thereof.

Another drawback of the known charging methods is that they always require careful preparation. Both the primer and the detonator must be applied, correctly positioned, at the mouth of the drillhole before the charge is introduced into the hole.

The principal aim of the present invention is to provide a charging apparatus which, while eliminating the above-mentioned drawbacks, will make possible the reliable and rapid charging of large holes. For this purpose heavy so-called pipecharges are used, which may range in length up to approximately 2 meters and in weight between 15 and 30 kg. With the new apparatus the charges are fed into the drillhole one after the other, for which purpose it may in some circumstances be appropriate to use so-called climbers (cf. Swedish patent application No. 8003974-6), which are capable of moving by themselves inside the hole while pressing against the walls thereof. The purpose of the said climbers in the present case is to propel charges ahead of them up the drillhole in order to relieve the load on the coming charges, thus avoiding the risk of bursting the outer shell of the latter.

An apparatus of the type mentioned in the ingress hereto and meeting the requirements set up is characterized primarily in that it comprises a stand, capable while pivoting on a fixed surface of being aligned with the mouth of a drillhole and provided with lifting means incorporating a rest, moveable towards and away from said drillhole, for the purpose of carrying a pipecharge, that part of the stand aligned with said drillhole consisting of a guiding unit arranged to guide the pipecharges, which may be self-retaining, into said drillhole as said rest travels towards said drillhole. The apparatus should also include means for fixing the apparatus between the mouth of the drillhole and the surface whereon the apparatus stands. The guide unit consists preferably of a guide pipe at least partially insertable in the drillhole, which guide pipe may be telescoping. It is furthermore advantageous to provide the guide unit with retaining means to retain the pipecharge after the lift.

The invention is more particularly described below in the form of examples of embodiment, reference being made to the following drawings.

FIGS. 1*a*–1*f* show in elevation the general principles of the new charging apparatus when charging a vertical rising drillhole.

Figure 2:
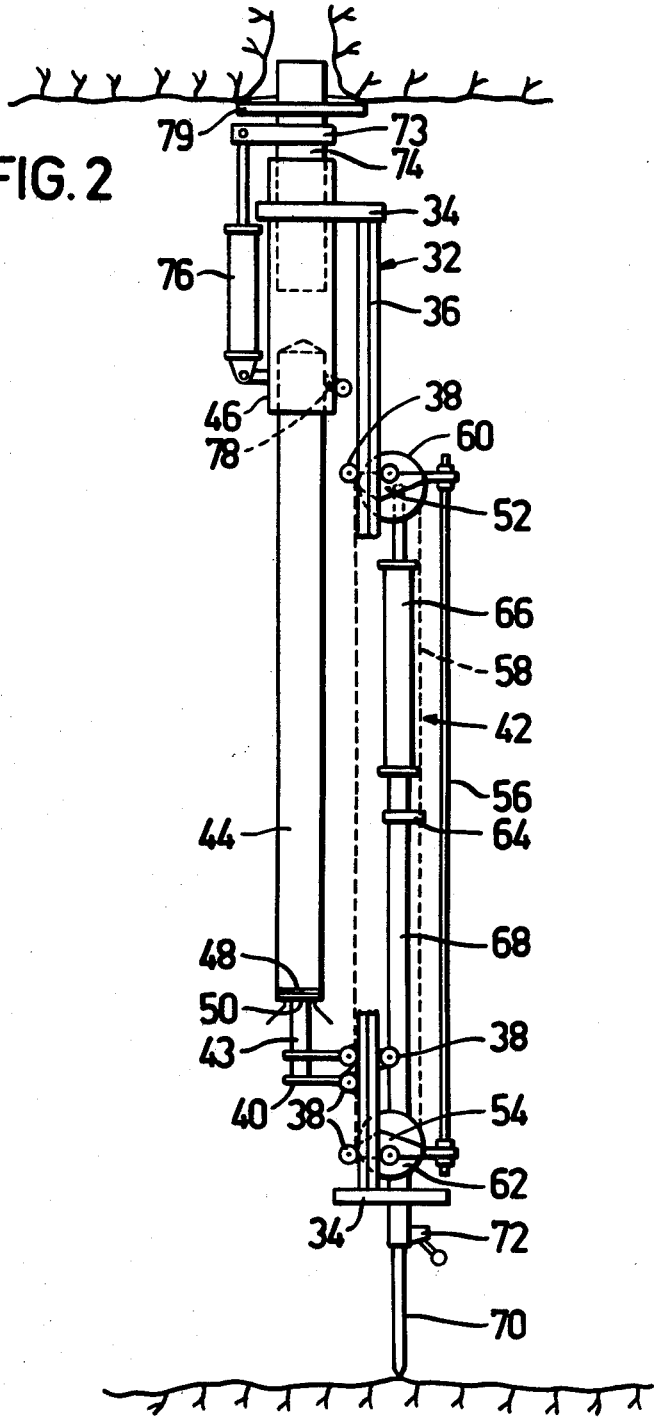

FIG. 2 shows in elevation and in greater detail a charging apparatus designed in accordance with the principles of the invention.

Figure 3A:
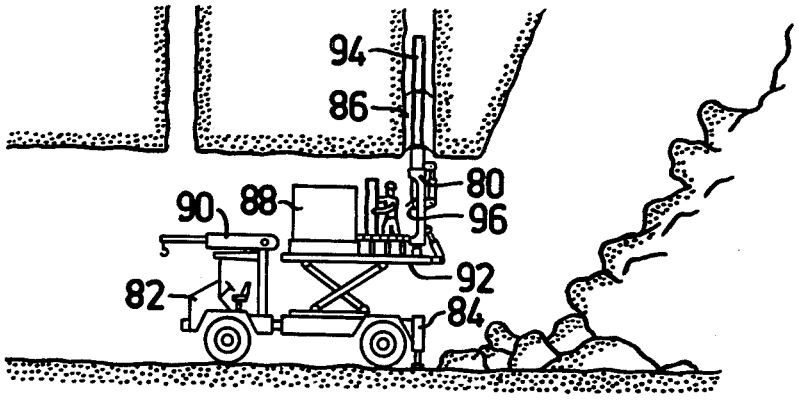
Figure 3B:
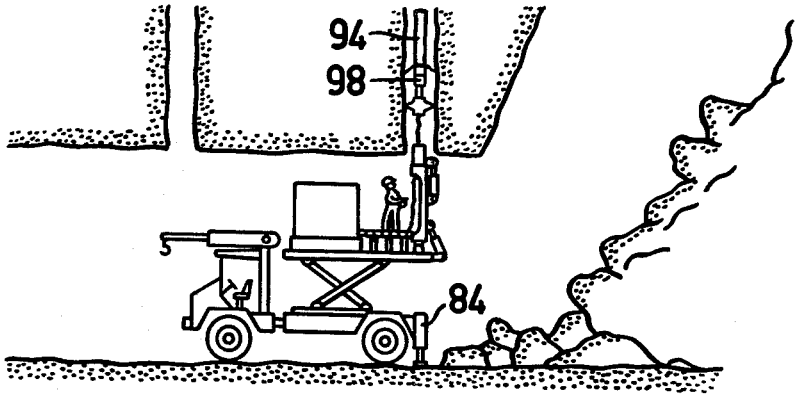
Figure 3C:
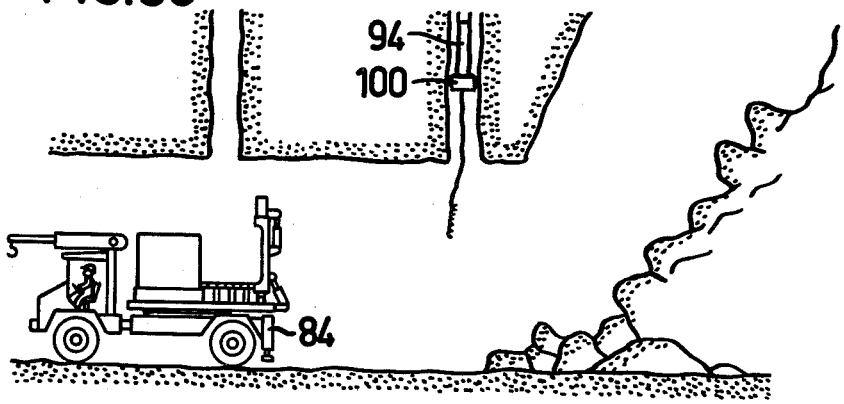

FIGS. 3*a*–3*c* show a vehicle-mounted apparatus designed in accordance with the principles of the invention, at various atages of the charging operation.

FIG. 1 shows the main principles of the charging of a vertical rising drillhole 10, using a charging apparatus 12 which comprises a stand 14 with a forward guide pipe 16 and including a lifting means 18. In the case presented the lifting means consists of a reciprocating slide actuated by a cylinder powered by a pressure medium, and includes a laterally projecting rest 20. The rest is designed to carry a pipecharge 22 or a climber 24 placed with one end resting thereon.

In FIG. 1 the charging apparatus 12 is set up between a fixed surface 26, which in the present case may be the floor of a horizontal drift, and the mouth 28 of the drillhole 10. FIG. 1*a* shows the start of the charging procedure. The required number of uniform charges 22 and climbers 24 are placed close to the charging apparatus 12. FIG. 1*b* shows the charging apparatus after the first pipecharge has been positioned on the moveable rest 20. In FIG. 1*c* the said pipecharge 22 has been lifted into the drillhole 10. At this point the charge can be temporarily retained by the retaining means 30 while the rest 20 is returned to its starting point. A fresh pipecharge 22 is positioned on the rest below the first charge, as shown in FIG. 1*d*, and is lifted up by means of the rest 20. In the course of the lift the lower end of the upper pipecharge comes in contact with the upper end of the lower charge, so that both charges are advanced. With the two charges 22 temporarily retained in the elevated position the rest 20 is again lowered to its starting point, whereupon a climber 24 is placed on the rest. This is illustrated in FIG. 1*e*. The climber 24 is lifted in the same manner as the pipecharges 22 were, with the rest 20 propelling ahead both the climber and the two pipecharges. When the climber 24 has been lifted to the correct position in the charging apparatus 12 it is capable of feeding the pipecharges 22 the rest of the way up the drillhole 10. The starting phase of this operation is shown in general terms in FIG. 1*f*. Additional pipecharges and climbers, as required, may then be fed into the drillhole in the manner described, so as to completely fill the hole.

In the arrangement illustrated in FIG. 2 the charging apparatus consists of a stand 32, including two matching, parallel columns 36 united at their top and bottom ends with cross-yokes 34. The columns 36 are square in section and face each other diagonally so that two of their edges forms tracks for matching V-grooved runners 38 mounted on the support 40 of the lifting means and on a belt carriage 42.

The support 40 carries a tubular upright 43 the top surface of which constitutes a rest for the upturned pipecharge 44. The latter is held in place partly by inserting its upper end, in the course of loading onto the charging apparatus, into the lower end of a guide pipe 46, and partly by means of a guide ring 48 matching the pipecharge's 44 spring washer 50, which acts as a retaining means. The height of the upright 43 is chosen so that the rest projects approximately 10 cm into the guide pipe 46 when the upright is at the upper limit of its travel.

The belt carriage 42, which, including its upper and lower travelling elements 52 and 54, extends the length of the travel of the rest, constitutes a traversing unit with the aid of twin spacing rods 56 whereby twin V-belts 58 can be kept tensioned over sheaves 60, 62. One strand of the V-belt is attached to a base unit 64 and the other strand is attached to the support 40.

The belt carriage 42 can be raised by means of a pneumatic cylinder 66 which rests on a hollow upright 68 projecting up from the lower transverse yoke, the end of the piston rod being connected to the axle of the upper sheave. The hollow upright support element houses the continuation of a ground peg 70 which by means of a known clamping device 72 can be withdrawn to increase the telescopic range of the guide pipe 46 when the height of the back so requires.

When the belt carriage 42 is lifted the rest 43 will be caused, by reason of the attachments of the V-belt, to travel twice the distance upwards.

The telescopically formed guide pipe 46 is united externally to the upper cross-yoke 34 of the stand. The flanged 73 inner pipe 74 can be protruded therefrom by means of a pneumatic cylinder 76, whereby the charging apparatus is fixed between the floor and the back. The lower end of the guide pipe is provided with a retaining device 78 to temporarily retain the pipecharge 44 after the lift. Instead of using a separate retaining means, as shown in the drawing, the inside of the guide pipe may be grooved to provide a good grip for the retaining springs, if any, on the pipecharges. The inner pipe 74 is also provided with an external transverse rest 79 to bear against the back of the tunnel round the mouth of the hole.

FIG. 3 shows a charging apparatus 80 mounted on a motor-powered vehicle 82. With an arrangement of this kind the charging apparatus can be simply and rapidly transported from one drillhole to another in a crosscut.

The motorized vehicle 82 carrying the charging apparatus 80 is provided with a withdrawable supporting leg 84 to provide a firm support against the chassis of the vehicle for the charging apparatus as the latter is aligned with a drillhole 86. Besides the charging apparatus itself, which may be of the design illustrated in FIG. 1, the vehicle carries a pipecharge magazine 88, which can be lifted off and onto the vehicle by means of a hydraulic crane arrangement 90. In the present case the charging apparatus 80 is mounted on a lifting table 92. The pipecharges can be fed into the charging apparatus 80 from the magazine 88 either manually or by mechanical loading means.

FIG. 3*a* shows the charging apparatus 80 aligned with the drillhole 86. A number of pipecharges 94 have already been fed into the drillhole by means of the lifting means 96. In FIG. 3*b* the climber 98, having been fed into the drillhole by the charging apparatus, has taken over the propulsion of the pipecharges. After further pipecharges have been fed in, the primer and detonator 100 are applied at the bottom end of the pipe, whereupon the charging apparatus is lowered by the lifting table 92 into the transport position, illustrated in FIG. 3*c*, in which position it can be locked. The leg 84 of the vehicle has now been released and the vehicle can be driven to wherever it is required.

Modifications of the above-described charging apparatuses are of course possible within the terms of the following claims. The lifting means, for example, may be powered by other means, such as rotating motors with associated mechanical arrangements. Different types of prime movers can be used.

We claim:

1. Apparatus for charging rising drillholes having large bores with heavy pipecharges comprising:

(a) a stand having an upper end portion and a lower end portion, said lower end portion pivotal on a fixed surface and said upper end portion capable of alignment with the mouth of a rising drillhole, (b) a guide unit including a first guide member having an upper end and a lower end, said first guide member being rigidly attached to said upper end portion of said stand, and a second guide member having a bore of a size sufficient for receiving a pipecharge, said second guide member having a lower end portion telescopically receivable within said upper end or said first guide member and an upper end portion extendable beyond said upper end of said first guide member and receivable within said mouth of said drillhole, (c) anchoring means attached to said upper end portion of said second guide member, (d) drive means interconnecting said first and said second guide members for moving said second guide member relative to said first guide member, thus securing said anchoring means in abutting relationship against the area of the formation adjacent to said mouth of said drillhole thereby wedging said charging apparatus between said fixed surface and said formation, and (e) lifting means associated with said stand including a rest platform for carrying a pipecharge, said platform capable of traveling toward and away from said lower end of said first guide member whereby said pipecharge, when supported on said rest platform, will be guided into said drillhole by said guide unit when said platform is moved toward said lower end of said first guide member.

2. Apparatus as in claim 1 and wherein:

(a) said guide unit being equipped with retaining means for retaining said pipecharge after said pipecharge is guided into said drillhole.

3. Apparatus as in claim 1 and wherein:

(a) said apparatus being mounted on a motor vehicle which acts as said fixed surface.

4. Apparatus as in claim 3 and wherein:

(a) said motor vehicle being provided with a lifting table for aligning said apparatus with respect to said drillhole.

* * * * *